US008106354B2

(12) United States Patent
Henry et al.

(10) Patent No.: US 8,106,354 B2
(45) Date of Patent: Jan. 31, 2012

(54) MASS SPECTROMETER ARRANGEMENT

(75) Inventors: Markus Henry, Cologne (DE); Christian Beyer, Cologne (DE)

(73) Assignee: Oerlikon Leybold Vacuum GmbH, Cologne (DE)

( * ) Notice: Subject to any disclaimer, the term of this patent is extended or adjusted under 35 U.S.C. 154(b) by 132 days.

(21) Appl. No.: 12/663,946

(22) PCT Filed: Jun. 3, 2008

(86) PCT No.: PCT/EP2008/056848

§ 371 (c)(1),
(2), (4) Date: Dec. 10, 2009

(87) PCT Pub. No.: WO2008/151968

PCT Pub. Date: Dec. 18, 2008

(65) Prior Publication Data

US 2010/0176294 A1 Jul. 15, 2010

(30) Foreign Application Priority Data

Jun. 11, 2007 (DE) ..... 10 2007 027 352

(51) Int. Cl.
*F04D 19/04* (2006.01)

(52) U.S. Cl. ..... 250/289; 415/55.6; 415/90; 417/423.4

(58) Field of Classification Search ..... 250/289, 250/281, 282; 415/55.6, 90, 143; 417/423.4
See application file for complete search history.

(56) References Cited

U.S. PATENT DOCUMENTS

| | | | | |
|---|---|---|---|---|
| 4,116,592 | A * | 9/1978 | Cherny et al. | 417/423.4 |
| 5,818,041 | A | 10/1998 | Mordehai et al. | |
| 6,193,461 | B1 | 2/2001 | Hablanian | |
| 7,866,940 | B2 * | 1/2011 | Stones et al. | 415/55.6 |
| 2002/0079442 | A1 | 6/2002 | Fries et al. | |
| 2004/0169139 | A1 | 9/2004 | Sakairi et al. | |
| 2008/0138219 | A1 * | 6/2008 | Stones et al. | 417/423.4 |

FOREIGN PATENT DOCUMENTS

| | | | |
|---|---|---|---|
| DE | 60023216 | T2 | 7/2006 |
| EP | 1464943 | A2 | 6/2004 |
| WO | 2005033520 | A1 | 4/2005 |

* cited by examiner

*Primary Examiner* — Kiet Nguyen
(74) *Attorney, Agent, or Firm* — Fay Sharpe LLP

(57) ABSTRACT

The invention refers to a mass spectrometer arrangement (10) comprising a housing (86) having a mass spectrometer forevacuum vacuum chamber (20) with a mass spectrometer forevacuum outlet (30), at least two mass spectrometer high-vacuum vacuum chambers (21, 22, 23), and an integrated turbomolecular pump (12) connected with the high-vacuum vacuum chambers (21, 22, 23) and having a forevacuum outlet (89). The two forevacuum outlets (30, 89) open into a common forevacuum chamber (98) in the housing (86), which in turn opens into a housing outlet (88).

7 Claims, 1 Drawing Sheet

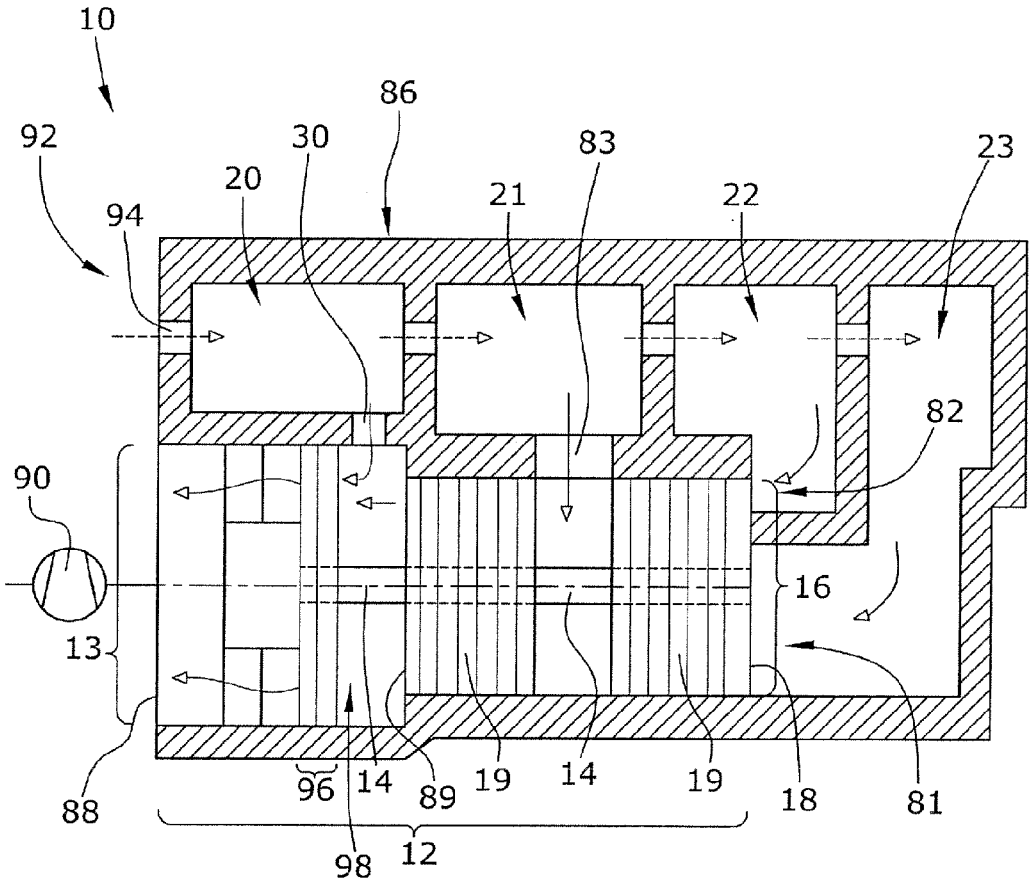
10
86
92
30
83
23
20
21
22
94
82
90
16
13
88
96
14
89
19
14
19
18
81
98
12

MASS SPECTROMETER ARRANGEMENT

BACKGROUND

The invention refers to a mass spectrometer arrangement comprising a mass spectrometer forevacuum chamber with a forevacuum outlet and at least two mass spectrometer high-vacuum chambers, as well as a turbomolecular pump connected with the high-vacuum chambers.

In such mass spectrometer arrangements a turbomolecular pump, a forevacuum pump for the turbomolecular pump, as well as another forevacuum pump for the mass spectrometer forevacuum chamber are required to supply the mass spectrometer with corresponding vacuums. Such an arrangement is complex and costly.

In view of this it is an object of the invention to provide an economic mass spectrometer arrangement.

SUMMARY

In accordance with the present application, a mass spectrometer arrangement comprises an integrated turbomolecular pump set into the housing of the mass spectrometer. The high-pressure chambers of the mass spectrometer are directly connected with the turbomolecular pump through channels internal to the housing. Moreover, it is provided that the forevacuum outlet of the mass spectrometer forevacuum chamber and the forevacuum outlet of the turbomolecular pump open into a common forevacuum chamber within the mass spectrometer housing. The forevacuum chamber eventually terminates in a single housing outlet that leads to an external forevacuum pump, if so desired.

By integrating the turbomolecular pump in the housing of the mass spectrometer, a very compact and relatively simple mass spectrometer arrangement is realized. By combining the forevacuum outlets of the mass spectrometer forevacuum chamber and of the turbomolecular pump into a single common forevacuum chamber within the housing, a further structural simplification is obtained.

In a preferred embodiment, the turbomolecular pump has a forevacuum compressor stage in addition to the high-vacuum compressor stages, which forevacuum compressor stage is arranged between the forevacuum chamber, into which the forevacuum outlets of the mass spectrometer and of the turbomolecular pump opening, and the housing outlet. Thus, a compression of the forevacuum pressure from 1-5 mbar to 5-10 mbar or more is effected already in the mass spectrometer housing. Accordingly, the forevacuum pump to be connected to the forevacuum housing outlet can be configured correspondingly small. The forevacuum compressor stage of the turbomolecular pump may theoretically also be designed such that it compresses up to atmospheric pressure so that an external forevacuum pump is no longer needed.

The turbomolecular pump may be mounted into the mass spectrometer housing by successively assembling its individual components therein. In a preferred embodiment, however, the turbomolecular pump is designed as a housing-less cartridge set into the housing of the mass spectrometer. Since the turbomolecular pump is realized as a housing-less cartridge whose housing is formed by the mass spectrometer housing or the structures therein, a separate turbomolecular pump housing can be omitted. This not only saves structural space and weight, but basically also reduces the flow resistances of the inlets and outlets of the turbomolecular pump correspondingly.

Preferably, the turbomolecular pump has an intake opening distal of its inlet rotor stage, which opening has at least two separated opening sections that are each connected with a mass spectrometer high-vacuum chamber. In the plane of the intake opening the turbomolecular pump comprises at least two separated opening sections. The rather large-area intake opening that is generally of an annular shape and directly adjoins the inlet rotor stage, is divided into two or possibly more opening sections. By varying the size of the opening sections and their radial positions, the pressure level and the pumping capacity required for a respective high-vacuum chamber can be adjusted accordingly. Dividing the intake opening into two or more opening sections requires little technical effort. Since all opening sections lie in the plane of the intake opening, good conductance values and thus little intake performance losses can be realized despite the fact that the opening section areas are reduced with respect to the intake opening surface. Dividing the intake opening into a plurality of intake opening sections is a compact solution that correspondingly reduces the number of intermediate inlets of the turbomolecular pump distributed along the pump axial line.

Still further advantages of the present invention will be appreciated to those of ordinary skill in the art upon reading and understand the following detailed description.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

The FIGURE is a sectional view of a mass spectrometer arrangement.

DETAILED DESCRIPTION

The FIGURE illustrates a mass spectrometer arrangement 10 comprising a mass spectrometer 92 with a mass spectrometer housing 86 and a turbomolecular pump 12. The turbomolecular pump 12 is designed as a housing-less cartridge 13 that is inserted into the housing 86.

The mass spectrometer 92 may be embodied as a quadrupol mass spectrometer, for instance, but it may also be any other type of mass spectrometer. The present mass spectrometer has four vacuum chambers 20, 21, 22, 23 through which an ion current flows that is illustrated as broken-line arrows. The highest-pressure vacuum chamber 20 is a forevacuum vacuum chamber into which the ion current flows through a housing inlet 94 for the ion current. Inside the forevacuum vacuum chamber 20, an ionizing pressure of 1-5 mbar prevails. The high-vacuum chambers 21, 22, 23 following in the flow direction of the ion current show pressures of $10^{-1}$ to $10^{-7}$ mbar.

The turbomolecular pump 12 is designed as a cartridge 13, i.e. it has no housing of its own. The turbomolecular pump cartridge 13 is set into the housing 86 without a housing. The pump stators 19 of the high-vacuum portion of the turbomolecular pump 12 are thus held immediately by the housing 86 or the inner structures of the housing 86.

In its high-vacuum portion, the turbomolecular pump 12 has an intermediate inlet 83 as well as two opening sections 81, 82 forming further high-vacuum inlets. The opening sections 81, 82 are formed by a corresponding division of the intake opening 16 that is arranged distally of inlet rotor stage. The intake opening 16 immediately adjoins the inlet rotor stage 19 and is formed by the housing 86.

The intake opening 16, whose shape is that of a circular surface, is divided into the two opening sections 81, 82 by conduit walls of the housing 86. The opening sections 81, 82 are circular in top plan view, but they may also take the shape of a sector, of concentric circular rings or another shape.

At its forevacuum outlet 89 that delimits the high-vacuum portion of the turbomolecular pump from the outer side, the turbomolecular pump comprises a rotor- and stator-free forevacuum chamber 98 into which flow both the gas coming from the high-vacuum portion of the turbomolecular pump 12 and the gas coming through the forevacuum outlet 30 from the forevacuum vacuum chamber 20.

The turbomolecular pump 12 has a forevacuum compressor stage 96 following the forevacuum chamber 98, seen in the flow direction, in which stage the gas from the forevacuum chamber 98 is compressed to a pressure of 5-10 mbar or more. Thereafter, the gas leaves the housing 86 through a housing outlet 88, from where it is fed to an external forevacuum pump 90 via a conduit. A rotor shaft 14 of the turbomolecular pump 12 carries the rotor stages of the high-vacuum portion and of the forevacuum compressor stage 96.

The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof.

The invention claimed is:

1. A mass spectrometer arrangement comprising:

a housing comprising:

a mass spectrometer forevacuum vacuum chamber with a mass spectrometer forevacuum outlet, at least two mass spectrometer high-vacuum vacuum chambers, an integrated turbomolecular pump connected with the high-vacuum vacuum chambers and having:

a forevacuum outlet, and an intake opening distal of an inlet rotor stage, said intake opening comprising at least two separated opening sections each connected with a different one of the high-vacuum vacuum chambers; and wherein the two forevacuum outlets open into a common forevacuum chamber in the housing, which in turn opens into a housing outlet.

2. The mass spectrometer arrangement of claim 1, wherein the turbomolecular pump comprises a forevacuum compressor stage between the forevacuum chamber and the housing outlet.

3. The mass spectrometer arrangement of claim 1, wherein the turbomolecular pump is a housing-less cartridge set into the housing.

4. A mass spectrometer arrangement comprising:

a housing defining:

a forevacuum chamber connected with a housing inlet, a first intermediate vacuum chamber fluidically connected with the forevacuum chamber, a higher vacuum chamber fluidically connected with the first intermediate vacuum chamber, and a turbomolecular pump chamber fluidically connected with the first intermediate vacuum chamber by a first aperture and with the higher vacuum chamber by a second aperture; and, a turbomolecular vacuum pump disposed in the turbomolecular pump chamber to pump gas from a high vacuum intake to an outlet, the high vacuum intake being connected directly to the first intermediate vacuum chamber by the first aperture and directly with the higher vacuum chamber via the second aperture such that a relative size and a relative radial position of the first and second apertures determines a pressure level and a pumping capacity of the turbomolecular vacuum pump.

5. The mass spectrometer arrangement of claim 4, wherein the turbomolecular vacuum pump is a housing-less cartridge and includes:

stators mounted to walls of the turbomolecular pump chamber; and rotors mounted adjacent the stators on a rotatable shaft rotatably mounted in the turbomolecular pump chamber.

6. The mass spectrometer arrangement of claim 4, further including:

a second intermediate vacuum chamber fluidically connected with the first intermediate vacuum chamber; and a third aperture defined between the second intermediate vacuum chamber and the turbomolecular pump chamber.

7. The mass spectrometer arrangement of claim 6, wherein the turbomolecular vacuum pump further includes:

a high vacuum stage which pumps gas from the high vacuum intake to a high vacuum stage discharge; and a second vacuum stage, the second vacuum stage having a second stage intake fluidically connected directly with the second intermediate chamber via the third aperture and with the high vacuum stage discharge.

* * * * *